US006675893B2

(12) United States Patent
Lund

(10) Patent No.: US 6,675,893 B2
(45) Date of Patent: Jan. 13, 2004

(54) SINGLE PLACEMENT WELL COMPLETION SYSTEM

(75) Inventor: Hans-Jacob Lund, Parker, CO (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 10/174,066

(22) Filed: Jun. 17, 2002

(65) Prior Publication Data

US 2003/0230406 A1 Dec. 18, 2003

(51) Int. Cl.[7] ..... E21B 43/08

(52) U.S. Cl. ..... 166/278; 166/297; 166/313; 166/55.1; 166/227

(58) Field of Search ..... 166/55, 55.1, 227, 166/278, 297, 313

(56) References Cited

U.S. PATENT DOCUMENTS

| | | | | |
|---|---|---|---|---|
| 3,939,927 A | | 2/1976 | Bohn | |
| 4,372,384 A | | 2/1983 | Kinney | |
| 4,479,556 A | | 10/1984 | Stout et al. | |
| 4,540,051 A | | 9/1985 | Schmuck et al. | |
| 4,655,283 A | * | 4/1987 | Pritchard, Jr. | 166/55.1 |
| 4,700,777 A | * | 10/1987 | Luers | 166/278 |
| 4,817,717 A | | 4/1989 | Jennings, Jr. et al. | |
| 5,103,912 A | * | 4/1992 | Flint | 166/297 |
| 5,224,545 A | * | 7/1993 | George et al. | 166/297 |
| 5,333,688 A | | 8/1994 | Jones et al. | |
| 5,492,178 A | | 2/1996 | Nguyen et al. | |
| 6,095,245 A | | 8/2000 | Mount | |
| 6,241,013 B1 | | 6/2001 | Martin | |
| 6,298,915 B1 | * | 10/2001 | George | 166/297 |

* cited by examiner

*Primary Examiner*—David Bagnell
*Assistant Examiner*—Matthew J Smith
(74) *Attorney, Agent, or Firm*—Jeffrey R. Anderson

(57) ABSTRACT

A single placement well completion system wherein a perforating gun is vertically positioned alongside a filter in a cased subterranean well. The position of the filter and perforating gun remains fixed relative to the casing during perforating, fracturing and/or packing, and production of the well.

49 Claims, 4 Drawing Sheets

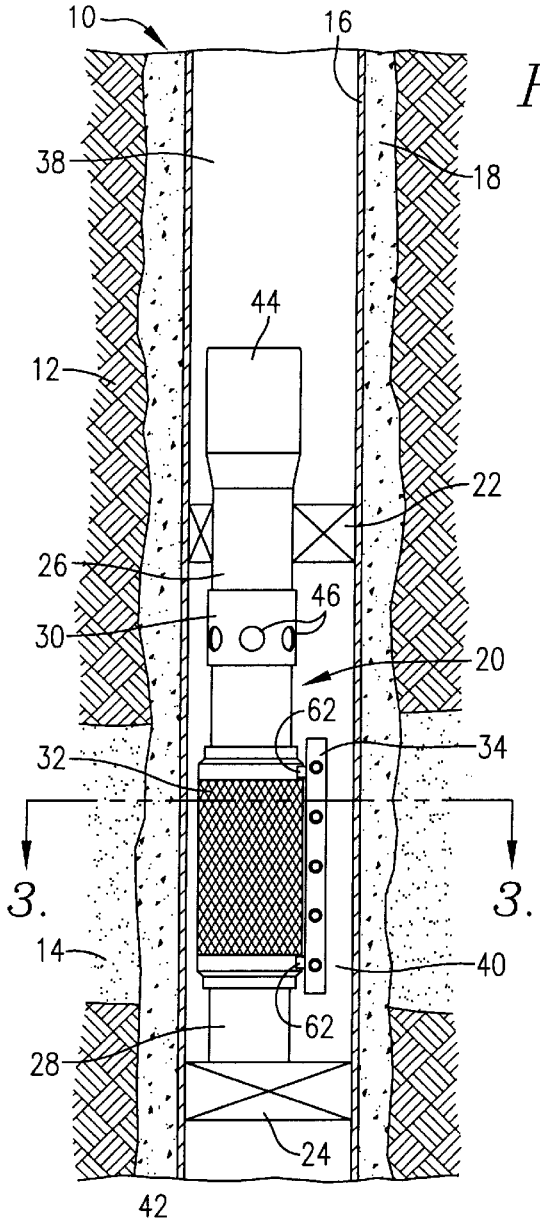
FIG. 1.
FIG. 2.
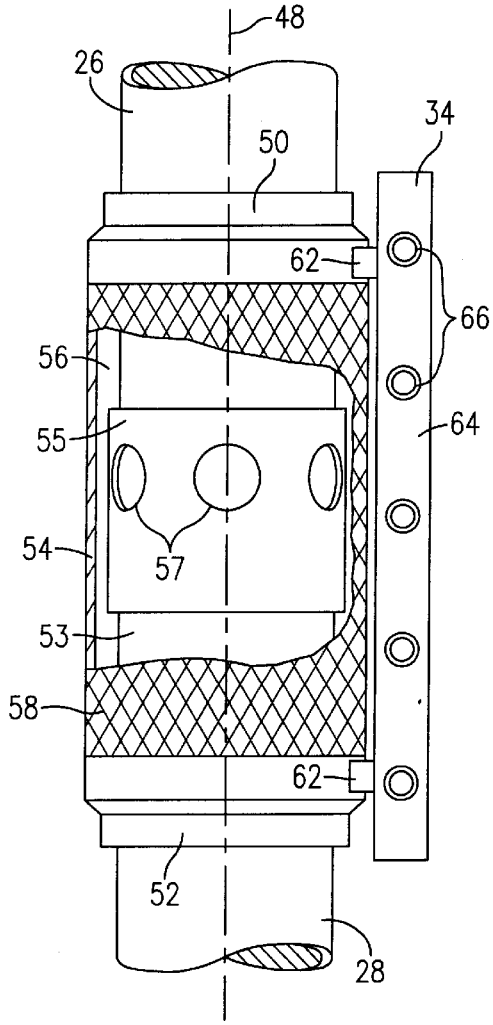
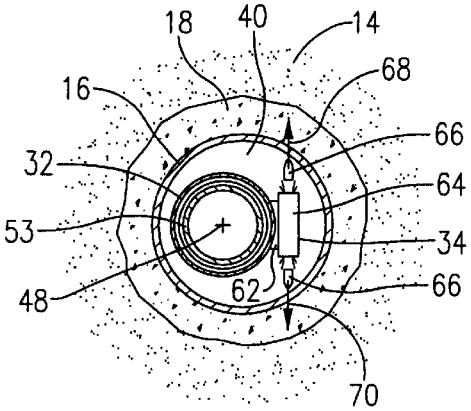
FIG. 3.

SINGLE PLACEMENT WELL COMPLETION SYSTEM

BACKGROUND OF THE INVENTION

1. Field of the Invention

The present invention relates generally to systems for completing subterranean wells. In another aspect, the invention concerns a system for perforating, fracturing, and/or packing a multiple-production zone hydrocarbon well with minimal rig time.

2. Description of the Prior Art

After the borehole of a subterranean well has been drilled, casing is typically run into the hole and cemented in place. Before fluid deposits (e.g., oil and/or gas) can be produced from the subterranean formation, the casing must be perforated adjacent a production zone of the formation. Prior to perforating, a high density "kill-weight" fluid is typically conducted into the well to produce overbalanced hydrostatic pressure within the wellbore (as compared to the nearby formation fluid pressures). In conventional well perforating operations, the use of such expensive kill-weight fluids is necessary to prevent excessive fluids from prematurely entering the wellbore from the formation.

It is commonly known that when fluids are produced from unconsolidated subterranean formations certain measures must be taken to inhibit the flow of solid particles of the formation into the production tubing. Two common methods of particulate control in subterranean wells include "gravel packing" and "frac-packing." During both gravel packing and frac-packing, a solid particulate material (e.g., 20–80 mesh sand) is placed between the interior of the casing and a screen that is vertically positioned adjacent perforations in the casing. The packing material may also be placed in the perforations extending into the subterranean formation. When the well is completed, the screen fluidly communicates with the production tubing so that fluid produced from the formation must flow through the screen prior to entering the tubing. The solid packing material placed in the annulus between the screen and the casing functions to inhibit the flow of particulates from the formation into the production tubing. Further, the solid packing material may function to help keep the perforations and/or fissures in the subterranean formation from collapsing.

Frac-packing operations combine the features of hydraulic formation fracturing and gravel packing in a single operation. During frac-packing, a mixture of a fracturing fluid (e.g., gelled water, brine, or liquid hydrocarbons) and the solid packing material (typically referred to as a "proppant") are pumped into the subterranean formation under a pressure sufficient to cause the fracturing fluid to enlarge the natural fissures in the formation and/or open up new fissures in the formation. Packers can be positioned in the casing of the wellbore as necessary to direct and control the flow of the frac-packing fluid to the desired portion of the well. During fracturing, the proppant material deposits in the fissures created by the fracturing fluid. After a desired degree of fracturing is achieved, additional proppant material is tightly packed in the annulus between the screen and the casing.

Most conventional techniques for perforating and packing (either gravel packing or frac-packing) a well require the rig to remain over the well while perforating and packing is being performed because the production tubing is typically run in the hole by the rig after perforating and packing. Conventional methods of perforating and packing a well can take several days, or more if multiple production zones are being perforated and packed. In view of the high daily rental rates on rigs (e.g., more than $100,000 per day for many offshore rigs), it would be highly advantageous to be able to set the production tubing and remove the rig from the well prior to perforating and packing the well in order to save rig time. Although it is known in the art that perforating guns can be conveyed into the well on the end of a string of production tubing, such tubing-conveyed perforating systems do not allow multiple production zones to be perforated and packed after the production tubing has been set and the rig has been removed.

OBJECTS AND SUMMARY OF THE INVENTION

It is an object of the present invention to provide a well completion system that consumes less rig time.

Another object of the invention is to provide a well completion assembly that can be maintained in a single fixed position during completion and production of a subterranean well.

Still another object of the present invention is to provide a well completion system that eliminates the need for the use of expensive high density kill-weight completion fluids.

Yet another object of the present invention is to provide a system for perforating and stimulating (i.e., packing, fracturing, or frac-packing) multiple production zones of a subterranean well with minimal time lapse between stimulation of the separate production zones.

It should be noted that the above-listed objects need not all be accomplished by the invention claimed herein, and other objects and advantages of the present invention will be apparent from the written description and appended drawings.

Accordingly, in one embodiment of the present invention, there is provided a well perforating and packing apparatus comprising an elongated porous filter and a perforating gun. The filter extends along a filter axis and has first and second axially spaced filter ends. The perforating gun is axially positioned relative to the filter at least partly between the first and second filter ends. The perforating gun is radially positioned relative to the filter at least partly outside the filter.

In another embodiment of the present invention, there is provided a well completion assembly that is positionable within a cased subterranean wellbore. The well completion assembly comprises an elongated upright member and a perforating gun. The member extends along a member axis and presents a generally cylindrical outer surface. The perforating gun is fixed relative to the member and is axially positioned alongside the member. The perforating gun is operable to propel a plurality of perforating charges outwardly therefrom in a manner such that the perforating charges do not contact the upright member.

In still another embodiment of the present invention, there is provided a completed well operable to produce fluids from a subterranean formation. The completed well comprises a generally upright string of casing, a packer, an elongated upright filter, and a perforating gun. The packer is disposed in the casing and fluidly isolates an upper portion of the casing from a lower portion of the casing. The filter is at least partly disposed in the lower portion of the casing and cooperates with the casing to define a filter annulus therebetween. The perforating gun is at least partly disposed in the filter annulus.

In yet another embodiment of the present invention, there is provided a method of completing a cased well extending in a subterranean formation that holds fluid deposits. The method comprises the steps of: (a) securing a completion assembly comprising an elongated upright conduit and a perforating gun relative to the casing of the well in a fixed position; (b) perforating the casing with the perforating gun while the completion assembly is in the fixed position; (c) packing the well by conveying a packing material downwardly through the conduit while the completion assembly is in the fixed position; and (d) producing fluids from the fluid deposits via the conduit while the completion assembly is in the fixed position.

In yet still another embodiment of the present invention, there is provided a method of completing a cased well extending in a subterranean formation that holds fluid deposits in at least two vertically spaced production zones. The method comprises the steps of: (a) securing a completion assembly comprising an elongated upright conduit, a first perforating gun, and a second perforating gun relative to the casing of the well in a fixed position; (b) perforating the casing in a first vertical location with the first perforating gun while the completion assembly is in the fixed position; and (c) perforating the casing in a second vertical location with the second perforating gun while the completion assembly is in the fixed position.

BRIEF DESCRIPTION OF THE DRAWING FIGURES

Preferred embodiments of the present invention are described in detail below with reference to the attached drawing figures, wherein:

FIG. 1 is partial sectional side view of a perforating and packing assembly disposed in a cased well, particularly illustrating the position of the perforating and packing assembly relative to a subterranean production zone.

FIG. 2 is an enlarged side view of the filter and perforating gun of the perforating and packing assembly, with certain portions of the filter element being cut away to better illustrate the production valve that is disposed in the filter element and that is operable to control fluid communication between the filter and the conduit to which the filter is coupled.

FIG. 3 is a sectional top view taken along line 3—3 in FIG. 1, particularly illustrating the orientation of the perforating gun relative to the filter, as well as, showing the firing directions of perforating charges from the perforating gun.

DETAILED DESCRIPTION OF THE PREFERRED EMBODIMENT

Figure 4:
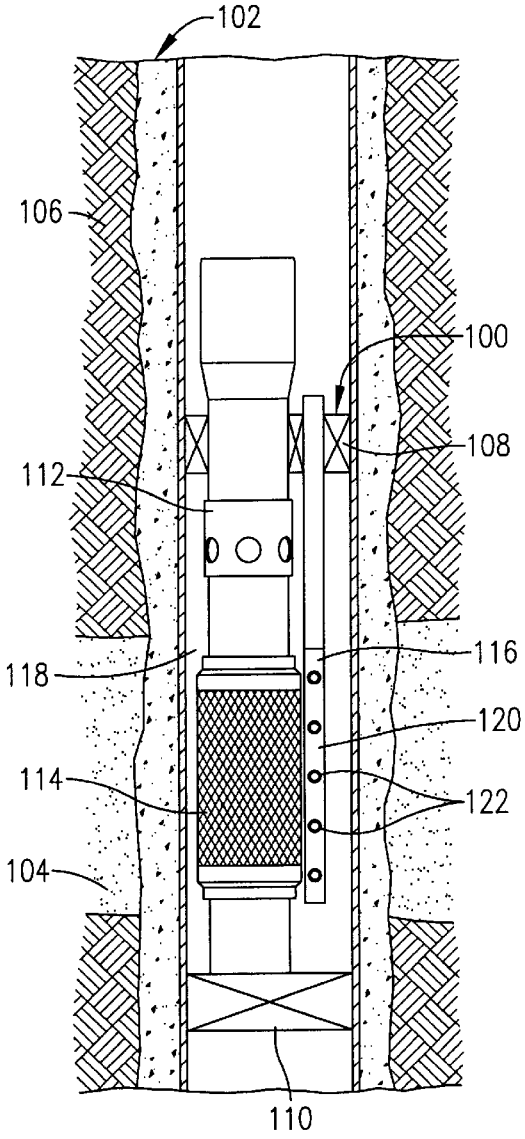
FIG. 4 is a partial sectional side view of an alternative perforating and packing assembly similar to the one illustrated in FIG. 1, but having the perforating gun supported by a packer rather than directly on the filter.

Referring initially to FIG. 1, a section of a cased well 10 is illustrated as extending into a subterranean formation 12 and through a production zone 14 of subterranean formation 12. Cased well 10 includes a string of casing 16, cement 18 disposed in the annulus defined between casing 16 and the wall of the borehole in subterranean formation 12, and a perforating and packing assembly 20 disposed in casing 16 and vertically positioned proximate production zone 14.

Perforating and packing assembly 20 generally includes an upper packer 22, a sump packer 24, an upper conduit 26, a lower conduit 28, a packing valve 30, a filter 32, and a perforating gun 34. Upper packer 22 fluidly isolates an upper portion 38 of casing 16 from a middle portion 40 of casing 16. Sump packer 24 fluidly isolates middle portion 40 of casing 16 from a lower portion 42 of casing 16. Upper conduit 26 extends through upper packer 22 and can provide fluid communication with a tubing string (not shown) extending above upper conduit 26 and coupled to upper conduit 26 via a tubing connection 44. Packing valve 30 is fluidly disposed in upper conduit 26 and vertically positioned between upper packer 22 and filter 32. Packing valve 30 defines a plurality of packing valve openings 46 that can provide fluid flow communication between the interior of upper conduit 26 and the annulus of middle portion 40 defined between perforating and packing assembly 20 and casing 16. Packing valve 30 is shiftable between an open position wherein fluid flow communication is provided between the interior of upper conduit 26 and middle portion 40 of casing 16 via packing valve openings 46 and a closed position wherein fluid flow communication between the interior of upper conduit 26 and middle portion 40 of casing 16 via packing valve openings 46 is substantially blocked. Packing valve 30 can be any downhole valve apparatus known in the art that selectively allows a fracturing fluid or a mixture of a carrier fluid and a solid packing material to flow therethrough. Preferably, packing valve 30 is a conventional sliding sleeve that can be actuated (i.e., opened and closed) by a wireline or other suitable means. Alternatively, packing valve 30 can be a circulating housing, or similar device, that is specially designed for frac-pack operations.

Referring now to FIG. 2, filter 32 is generally an elongated porous member that extends along a filter axis 48 and presents first and second axially spaced filter ends 50, 52. First end 50 of filter 32 is fluidly coupled to upper conduit 26, while second end 52 of filter 32 is fluidly coupled to lower conduit 28. Preferably, filter 32 is a selective screen. As used herein, the term "selective screen" shall denote a filtering device that includes an internal valve for selectively permitting and blocking fluid flow through the filter. Filter 32 preferably comprises a base pipe 53, a porous filter element 54, and a production valve 55. The upper end of base pipe 53 is fluidly coupled to upper conduit 26 while the lower end of base pipe 53 is fluidly coupled to lower conduit 28. Filter element 54 defines an interior filter space 56 and presents a generally cylindrical outer filter surface 58. Production valve 55 is fluidly disposed in base pipe 53 and is positioned in interior filter space 56. Production valve 55 defines a plurality of production valve openings 57 that can provide fluid flow communication between the interior of base pipe 53 and interior filter space 56. Production valve 55 is shiftable between an open position wherein fluid flow communication is provided between the interior of base pipe 53 and interior filter space 56 via production valve openings 57 and a closed position wherein fluid flow communication between the interior of base pipe 53 and interior filter space 56 via production valve openings 57 is substantially blocked. Production valve 55 can be any downhole valve apparatus known in the art that selectively allows fluids to flow therethrough. Preferably, production valve 55 is a conventional sliding sleeve that can be actuated (i.e., opened and closed) by a wireline or other suitable means. Filter 32 can be any filter or screen known in the art of gravel packing or frac-packing which selectively permits the flow of produced fluids therethrough while substantially blocking the flow of a predetermined size of solid particulates (e.g., the packing material) therethrough. For example, filter 32 can be configured to selectively block the flow of substantially all solid particulates larger than 40 mesh therethrough. The opening size of filter 32 can vary greatly depending on subterranean formation properties and various production parameters. Examples of suitable filters include, for example, commercially available screens, slotted or perforated liners or pipes, screen pipes, prepacked screens and/or liners, or combinations thereof.

Referring now to FIGS. 1–3, perforating gun 34 is axially positioned relative to filter 32 at least partly between first and second filter ends 50, 52 (as shown in FIG. 2). Perforating gun 34 is positioned radially outwardly from filter 32 (as shown in FIG. 3). In one embodiment of the present invention, perforating gun 34 is directly coupled to filter 32 via gun fasteners 62 which directly contact perforating gun 34 and outer surface 58 of filter 32. As perhaps best shown in FIG. 2, perforating gun 34 includes a main body 64 defining a plurality of barrels within which a plurality of perforating charges 66 are disposed. As perhaps best shown in FIG. 3, perforating gun 34 is operable to propel perforating charges 66 outwardly from main body 64 when perforating gun 34 is fired. Perforating gun 34 is operable to propel perforating charges 66 with sufficient velocity so that perforating charges 66 can penetrate entirely through casing 16 and cement 18, and into production zone 14. Perforating gun 34 is configured so that when perforating charges 66 are propelled outwardly from perforating gun 34, perforating charges 66 do not contact filter 32. Preferably, perforating gun 34 is configured so that when perforating charges 66 are fired, the firing forces exerted on main body 64 are substantially equal and opposite so that minimal force is exerted on fasteners 62 and filter 32 when perforating gun 34 is discharged. Most preferably, perforating gun 34 is configured to fire a first one-half of perforating charges 66 in a first firing direction 68 and a second one-half of perforating charges 66 in a second firing direction 70 that is generally opposite first firing direction 68. When perforating charges 66 are fired from perforating gun 34, it is preferred for each of the charges to be propelled in a direction that is substantially perpendicular to the direction of extension of filter axis 48, thereby exerting minimal axial and/or torsional force on fasteners 62 and filter 32. Perforating gun 34 can be any conventional perforating gun known in the art meeting the above-described parameters. Perforating gun 34 can be actuated (i.e., fired) by any conventional triggering means known in the art for actuating a perforating gun such as, for example, a pressure trigger, a wireline trigger, or a radio signal trigger. Most preferably, perforating gun 34 can be actuated by a pressure trigger that is triggered in response to an increase in the pressure in middle portion 40 of casing 16. Although not shown in FIGS. 1–3, it is within the ambit of the present invention for a plurality of perforating guns to be positioned around the circumference of the filter.

Referring again to FIGS. 1–3, prior to inserting perforating and packing assembly 20 into casing 16, a completion fluid is conducted into casing 16. Perforating and packing apparatus 20 is then lowered into casing 16 via a workpipe or wireline until filter 32 and perforating gun 34 are vertically positioned adjacent production zone 14. When perforating and packing assembly 20 is positioned in the proper vertical location, upper packer 22 and sump packer 24 are set to couple perforating and packing assembly 20 to casing 16 and fluidly isolate upper, middle, and lower portions 38, 40, 42 of casing 16. Once the position of perforating and packing assembly 20 is fixed relative to casing 16, a rig can be used to run a string of production tubing (not shown) into casing 16 and couple the production tubing to perforating and packing assembly 20 via tubing connection 44. After the production tubing has been run in the hole and coupled to perforating and packing assembly 20, the rig can be removed. Casing 16 can then be perforated by pressuring up middle portion 40 of casing 16 to thereby actuate a pressure trigger of perforating gun 34. While packing valve 30 is in the open position and production valve 55 is in the closed position, a packing material can be conducted at high pressures downwardly through the production tubing, into upper conduit 26, through packing valve openings 46, into middle portion 40 of casing 16, and into the perforations in production zone 14. The packing material is typically conveyed downhole along with a carrier fluid. The carrier fluid can be any conventional carrier fluid which is used in fracturing, frac-pack, gravel packing, or other similar procedures. Examples include: fresh water; brine; liquid hydrocarbons (e.g., gasoline, kerosene, diesel, crude oil, and the like) which are viscous and/or have viscosifiers or gelling agents incorporated therein; gelled water; and gelled brine. The carrier fluid is preferably a gelled aqueous composition formed from water, brine, or similar aqueous fluid. The packing material can be any conventional solid packing particulates which are typically used in frac-pack, gravel packing, or other similar procedures. The size and composition of the packing material can vary greatly depending on the properties of the subterranean formation and production parameters. For example, the packing material can comprise five to 100 mesh solid particulates such as sand, gravel, metallic spheres, glass beads, and the like. After packing and/or fracturing, coiled tubing can be run into the production tubing and upper conduit 26 to clean any remaining packing material out of the production tubing and upper conduit 26. The cleaning out of the production tubing and upper conduit 26 can be accomplished by flushing the remaining fracturing fluid and packing material out of the work string with a completion fluid. After cleaning, packing valve 30 can be closed and production valve 55 can be opened with a wireline. Perforating and packing assembly 20 is then configured for producing fluids from production zone 14, once production equipment is provided at the top of the production tubing.

In an alternative method of perforating and packing cased well 10, a high pressure working pipe (rather than production tubing) can be run into casing 16 after packers 22, 24 are set. It may be necessary to use such high pressure working pipe rather than conventional production tubing to fracture or frac-pack cased well 10 due to the high pressures associated with fracturing and frac-packing. When such a method is employed, the production tubing will not be run into casing 16 until after the perforating and packing operations have been completed.

Although not illustrated, it is within the ambit of the present invention for perforating and packing assembly 20 to simply be a perforating assembly that does not utilize filter element 54. This may be the case if the production zone is consolidated and particle control is not required. In such a case, the perforating gun would simply be positioned alongside a blank pipe (similar to base pipe 53) that includes a production valve (similar to production valve 55). Many advantages of the present invention (e.g., one-time placement of the assembly and setting of the production tubing prior to perforating) would still be realized even if filter element 54 were not employed.

Referring now to FIG. 4, an alternative perforating and packing assembly 100 is illustrated as being disposed in a cased well 102 adjacent a production zone 104 of a subterranean formation 106. Perforating and packing assembly 100 generally includes a dual upper packer 108, a sump packer 110, a packing valve 112, a filter 114, and a perforating gun 116. Dual upper packer 108 and sump packer 110 cooperatively define and fluidly isolate an isolation annulus 118 therebetween. Packing valve 112 and filter 114 are disposed adjacent isolation annulus 118. Perforating gun 116 is rigidly coupled to dual packer 118 and extends downwardly therefrom at least partly into isolation annulus 118. Perforating gun 116 includes a main body 120 that defines a plurality of barrels within which a plurality of perforating charges 122 are received. The portion of main body 120 that houses the perforating charges 122 is axially (i.e., vertically) positioned adjacent filter 114. Other than the system for supporting perforating gun 116 relative to filter 114 (via dual packer 108), the construction and operation of perforating and packing assembly 100 is substantially similar to that described above for perforating and packing assembly 20 with reference to FIGS. 1–3.

Figure 5:
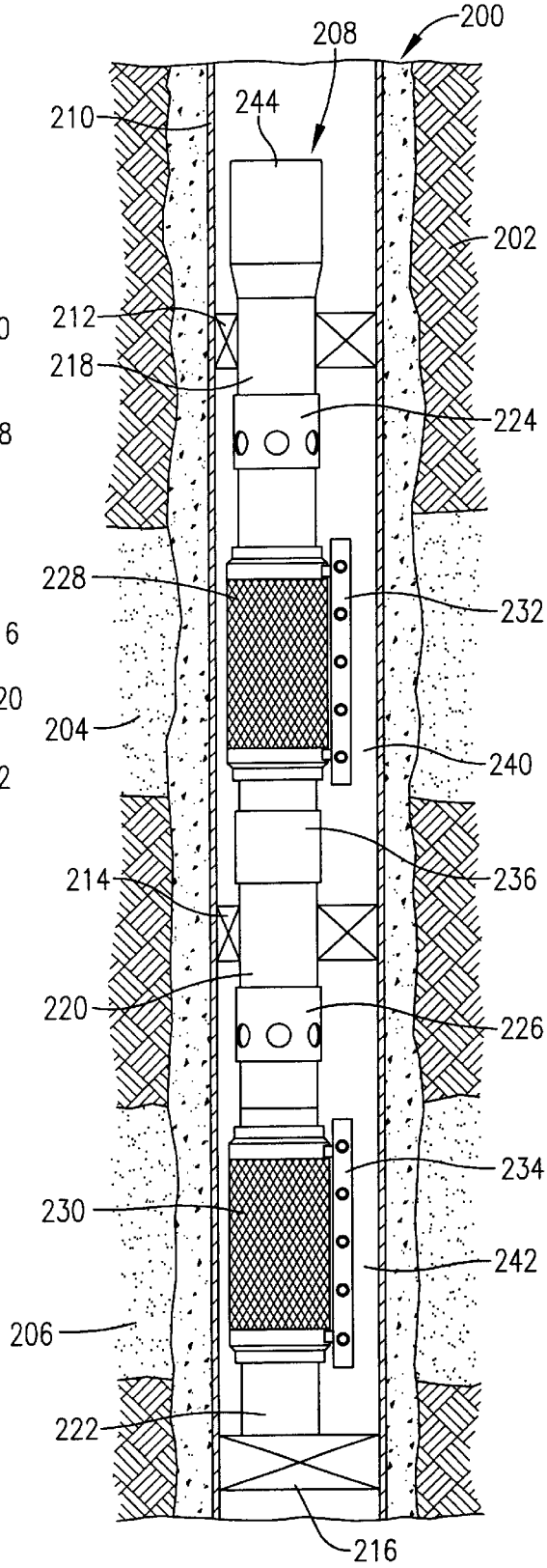
FIG. 5 is a partial sectional side view of a multiple zone perforating and packing assembly disposed in a cased well, particularly illustrating the position of the perforating and packing assembly relative to multiple vertically spaced subterranean production zones.

Referring now to FIG. 5, a section of cased well 200 is illustrated as extending into a subterranean formation 202 that comprises first and second vertically spaced production zones 204,206. A multiple zone perforating and packing assembly 208 is disposed in casing 210 of well 200. Perforating and packing assembly 208 generally includes: upper, middle, and lower packers 212, 214, 216; upper, middle, and lower conduits 218, 220, 222; first and second packing valves 224,226; first and second filters 228,230; first and second perforating guns 232, 234; and, optionally, an isolation valve 236. Preferably, filters 228, 230 are selective screens that include respective first and second production valves (not shown in FIG. 5, but similar to production valve 55 illustrated in FIG. 3). Upper, middle, and lower packers 212, 214, 216 fluidly isolate a first annulus 240 and a second annulus 242 from one another. Perforating and packing assembly 208 is adapted to be coupled to a string of production tubing (not shown) via a tubing connection 244. Isolation valve 236 (the use of which is optional) is operable to selectively block the flow of fluids through middle conduit 220. Isolation valve 236 can be any downhole valve known in the art for performing this function. Preferably, isolation valve 236 can be actuated (i.e., opened and closed) by a wireline. The components of perforating and packing assembly 208 that are common with perforating and packing apparatus 20 (illustrated in FIGS. 1–3) have substantially the same configuration and function as the corresponding components described above with reference to perforating and packing apparatus 20.

Figure 6:
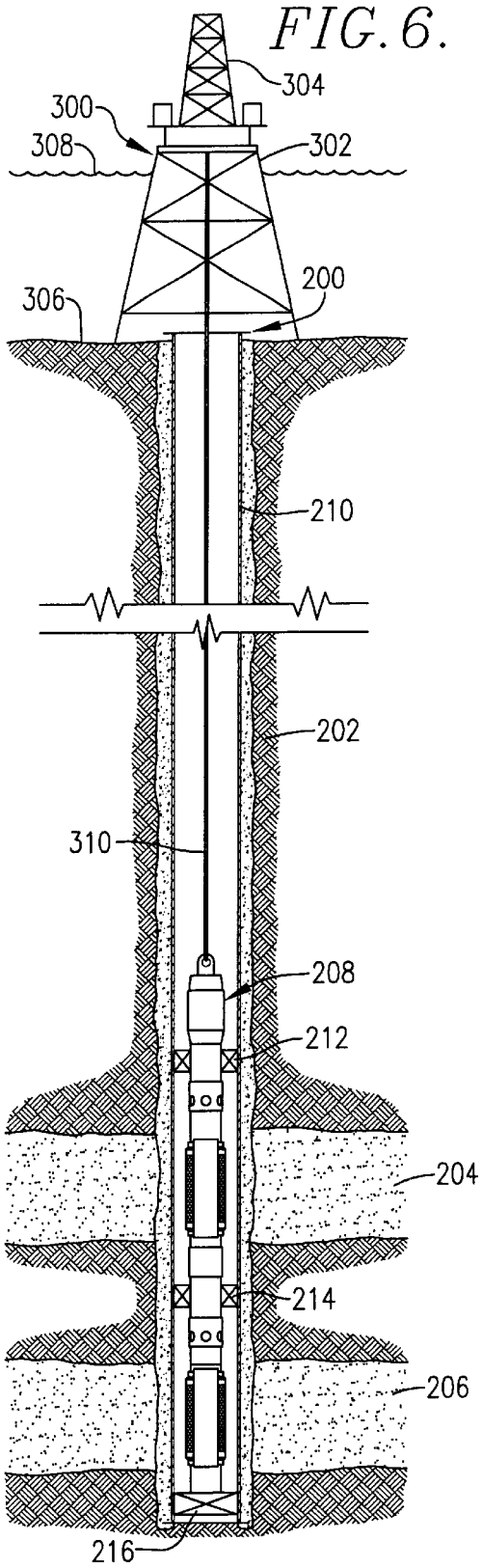
FIG. 6 is a partial sectional side view showing a well superstructure positioned over a cased wellbore, particularly illustrating the multiple zone perforating and packing assembly of FIG. 5 being positioned in the cased well by an offshore rig via a workpipe or wireline.

Referring now to FIG. 6, a well superstructure 300 is illustrated as generally comprising an offshore platform 302 and an offshore drilling rig 304. Offshore platform 302 is positioned in a body of water, extends upwardly from a seabed 306 and above the water surface 308. Offshore rig 304 is positioned on offshore platform 302 and is operable to drill well 200, run in casing 210, and run in production tubing. Well superstructure 300 is positioned generally over cased well 200. Perforating and packing assembly 208 is illustrated in FIG. 6 as being placed in cased well 200 adjacent first and second production zones 204, 206 via a workpipe or wireline 310 extending downwardly from well superstructure 300. After perforating and packing assembly 208 is properly vertically positioned in case well 200, upper, middle, and lower packers 212, 214, 216 can be set by workpipe or wireline 310.

Figure 7:
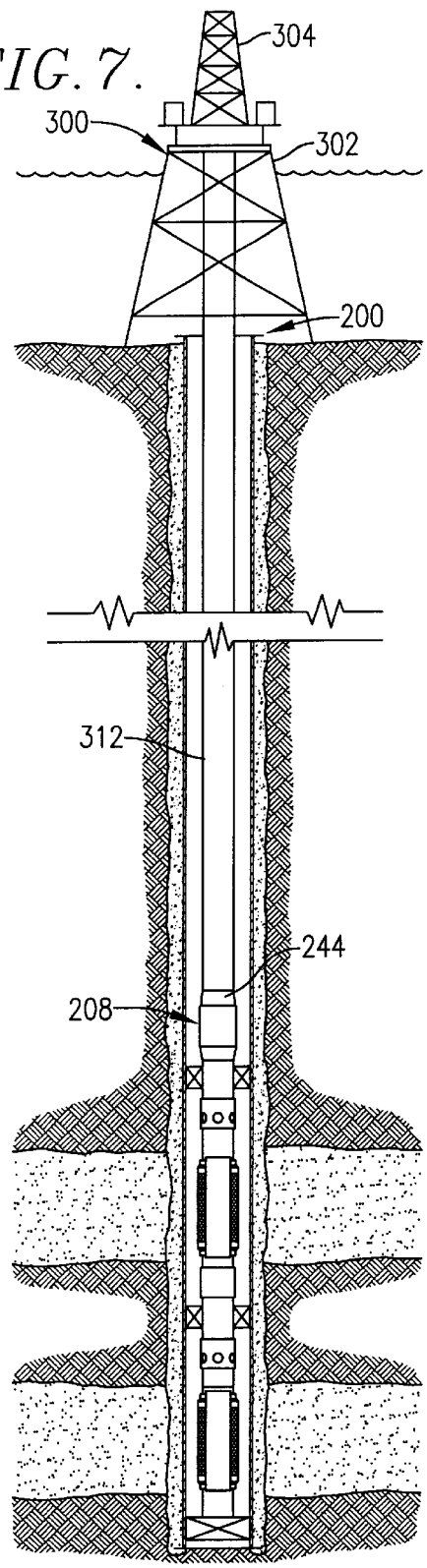
FIG. 7 is a partial sectional side view similar to FIG. 6, particularly illustrating a string of production tubing being placed in the wellbore and coupled to the perforating and packing assembly by the offshore rig.

Referring now to FIG. 7, after perforating and packing assembly 208 has been fixedly positioned in cased well 200, a string of production tubing 312 can be lowered into cased well 200 and coupled to tubing connection 244 of perforating and packing assembly 208 by rig 304. Once production tubing 312 has been set, rig 304 can be demobilized and removed from offshore platform 302.

Figure 8:
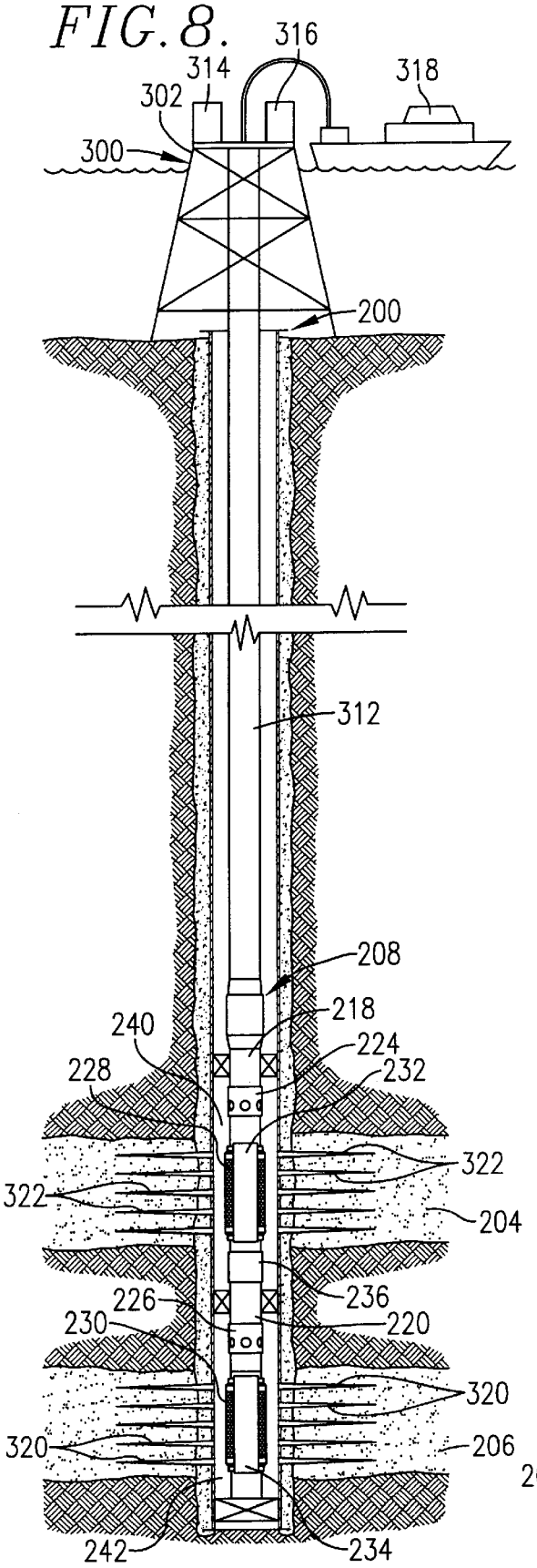
FIG. 8 is a partial sectional side view similar to FIG. 7, particularly illustrating the offshore rig being removed from the offshore platform and a stimulation vessel being coupled to the production tubing for stimulating the perforations in the production zones.

Referring now to FIG. 8, after production tubing 312 has been set, cased well 200 is ready to be perforated and packed. Prior to perforating and packing, wireline equipment 314 and coiled tubing equipment 316 are positioned on platform 302. Further, a stimulation vessel 318 that can be used for high pressure hydraulic fracturing or frac-pack operations is mobilized and positioned adjacent platform 302. Second production zone 206 can be perforated by actuating second perforating gun 234 to create second perforations 320. A carrier fluid and entrained packing material can then be pumped from stimulation vessel 318 downward through production tubing 212 and into perforating and packing assembly 208. Perforating and packing assembly 208 should initially be configured with first packing valve 224 being closed, first production valve of first filter 228 being closed, first isolation valve 236 being open, and second packing valve 226 being open. In this configuration, the carrier fluid and packing material are carried downwardly through production tubing 212, upper conduit 218, middle conduit 220, out through second packing valve 226, and into second annulus 242 and second perforations 320. After packing and/or fracturing second perforations 320, coiled tubing from coiled tubing equipment 316 can be run down production tubing 312 to flush out any remaining carrier fluid and/or packing material from production tubing 312, upper conduit 218, and middle conduit 220. The coiled tubing can then be removed from production tubing 312 and a wireline from wireline equipment 314 can be used to open the second production valve of second filter 230, close second packing valve 222, close first isolation valve 236 (optional), and open first packing valve 224. The portion of casing 210 that is adjacent first production zone 204 can then be perforated to provide first perforations 322. First perforations 322 and first annulus 240 can then be packed and/or fractured in the same manner as second perforations 320 and second annulus 242. After packing first perforations 322 and first annulus 240, coiled tubing can once again be used to clean out production tubing 312 and upper conduit 218. A wireline can then be used to close first packing valve 224.

Figure 9:
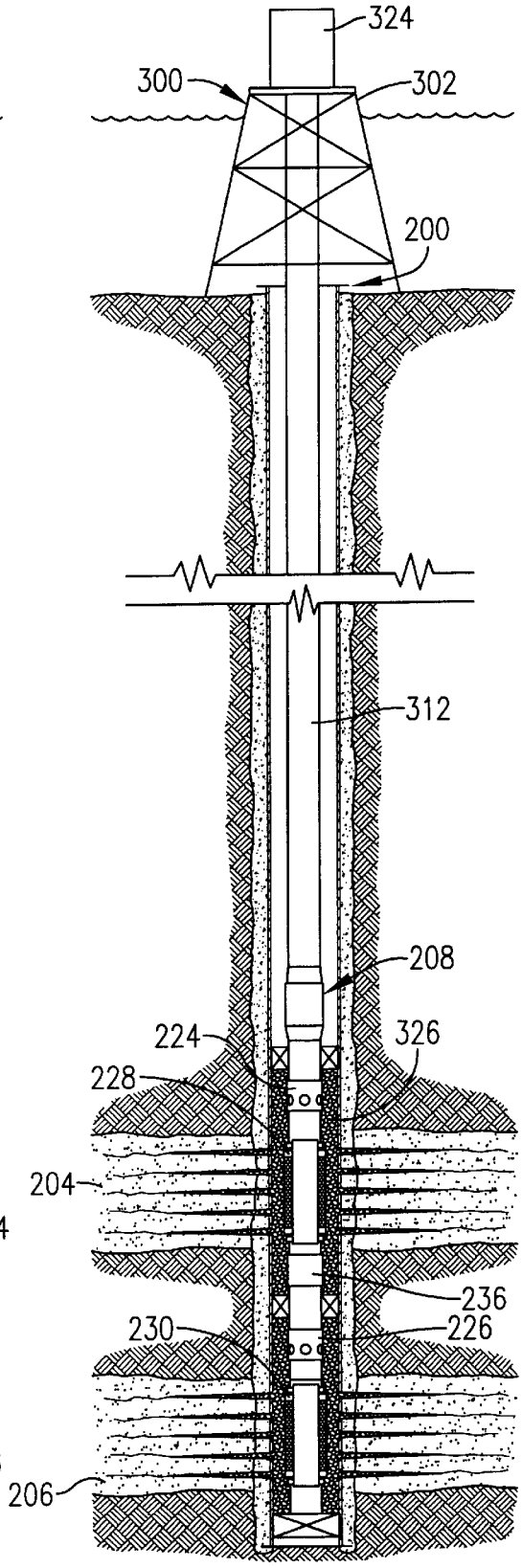
FIG. 9 is a partial sectional side view similar to FIG. 8, particularly illustrating a completed, producing offshore well extracting fluids from subterranean production zones through packing material disposed in the annulus between each filter and the perforated casing.

Referring now to FIG. 9, after perforating and packing first and second production zones 204, 206, production equipment 324 can be used to produce fluids from either or both production zones 204, 206. The produced fluids must flow through packing material 326 prior to entering production tubing 312. If it is desired to produce fluids from both production zones 204, 206, the first production valve of first filter 228, isolation valve 236, and the second production valve of second filter 230 are opened. If it is desired to produce fluids only from first production zone 204, the first production valve of first filter 228 is opened while first isolation valve 236 and the second production valve of second filter 230 are closed. If it is desired to produce fluids only from second production zone 206, the first production valve of first filter 228 is closed while first isolation valve 236 and the second production valve of second filter 230 are opened.

The completion system illustrated in FIGS. 6–9 allows rig 304 to be removed from offshore platform 302 prior to perforating and packing the well 200, thereby saving a substantial amount of rig time. In addition, such a system requires stimulation vessel 318 to be mobilized only once because of the minimal lapse of time between stimulating second production zone 206 and first production zone 204. Further, such a system eliminates the need for expensive kill-weight completion fluids due to the use of packers 212, 214, 216 to fluidly isolate the perforated portions of well 200.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention. For example, multiple completion assemblies can be vertically stacked when it is desired to complete and produce three or more vertically spaced subterranean production zones. Further, many different configurations of downhole packing valves, isolation valves, filters, perforating guns, and packers are known in the art and could be readily substituted for the exemplary components, described herein, without departing from the spirit and scope of the present invention.

The inventor hereby states his intent to rely on the doctrine of equivalents to determine and assess the reasonably fair scope of the present invention as pertains to any apparatus not materially departing from but outside the literal scope of the invention as set forth in the following claims.

What is claimed is:

1. A well perforating and packing apparatus comprising:

an elongated porous filter extending along a filter axis and having first and second axially spaced filter ends;

an internal filter valve configured to be opened and closed to selectively permit and block fluid flow through the filter; and a perforating gun axially positioned relative to the filter at least partly between the first and second filter ends, said perforating gun being radially positioned relative to the filter at least partly outside of the filter.

2. An apparatus according to claim 1, said perforating gun including a main body and a plurality of perforating charges, said perforating gun being operable to propel each perforating charge outwardly from the main body in a direction that is at least substantially perpendicular to the direction of extension of the filter axis.

3. An apparatus according to claim 2, said perforating gun being configured so that a first one-half of the perforating charges are propelled from the main body in a first firing direction and a second one-half of the perforating charges are propelled from the main body in a second firing direction generally opposite the first firing direction.

4. An apparatus according to claim 1, said filter being a selective screen.

5. An apparatus according to claim 1, said filter including a porous wall at least partly defining an interior filter space and presenting an outer filter surface, said perforating gun being disposed outside of the interior filter space.

6. An apparatus according to claim 5, said outer filter surface being substantially cylindrical and substantially centered on the filter axis.

7. A well perforating and packing apparatus comprising:

an elongated porous filter extending along a filter axis and having first and second axially spaced filter ends; and a perforating gun axially positioned relative to the filter at least partly between the first and second filter ends, said perforating gun being radially positioned relative to the filter at least partly outside of the filter;

said filter including a porous wall at least partly defining an interior filter space and presenting an outer filter surface, said perforating gun being disposed outside of the interior filter space, a fastener directly contacting the perforating gun and the filter, said fastener rigidly coupling the perforating gun to the filter.

8. An apparatus according to claim 5; and a conduit coupled to the filter, fluidly communicating with the interior filter space, and extending axially from the first end of the filter, said conduit at least partly supporting the perforating gun relative to the filter.

9. An apparatus according to claim 5; and a packer coupled to and extending radially outward from the conduit, said packer and said conduit cooperating to support the perforating gun relative to the filter.

10. A well completion assembly positionable within a cased subterranean wellbore, said well completion assembly comprising:

an elongated upright member extending along a member axis and presenting a generally cylindrical outer surface;

a perforating gun fixed relative to the member and axially positioned alongside the member, a production valve fluidly coupled to the member and axially positioned alongside the perforating gun; and a packing valve fluidly coupled to the member and axially spaced from the production valve, said perforating gun being operable to propel a plurality of perforating charges outwardly therefrom in a manner such that the perforating charges do not contact the member.

11. A well completion assembly according to claim 10, said member being production tubing for conducting a fluid extracted from a subterranean formation out of the wellbore.

12. A well completion assembly according to claim 10, said member being a filter including a porous wall that defines an interior filter space and presents the outer surface, said perforating gun being positioned outside the porous wall.

13. A well completion assembly according to claim 12; and an upper conduit coupled to the filter, fluidly communicating with the interior filter space, and extending axially from the filter, said upper conduit and the casing of the wellbore being operable to cooperatively define an upper annulus therebetween when the well completion assembly is positioned in the wellbore.

14. A well completion assembly according to claim 13; and an upper packer coupled to the upper conduit and axially spaced from the filter, said upper packer being operable to fluidly isolate at least a portion of the upper annulus from the space in the casing above the upper packer.

15. A well completion assembly according to claim 14, said packing valve being fluidly coupled to the upper conduit and disposed between the filter and the packer, said packing valve being selectively shiftable between an open position that permits fluid flow between the interior of the upper conduit and said at least a portion of the upper annulus through the packing valve and a closed position that at least substantially blocks fluid flow between the interior of the upper conduit and said at least a portion of the upper annulus through the packing valve.

16. A well completion assembly according to claim 15, said upper conduit comprising production tubing for conducting a fluid extracted from a subterranean formation out of the wellbore.

17. A well completion assembly according to claim 15; and a string of production tubing fluidly coupled to and extending axially from the upper conduit, said production tubing being operable to conduct a fluid extracted from a subterranean formation out of the wellbore.

18. A well completion assembly according to claim 15; and an end packer axially spaced from the filter and positioned on a generally opposite side of the filter as the upper packer, said end packer being operable to fluidly isolate said at least a portion of the upper annulus from the space in the casing below the end packer.

19. A well completion assembly according to claim 15; and a lower conduit coupled to the filter, fluidly communicating with the interior filter space, and extending axially from the filter on a generally opposite side of the filter as the upper conduit, said lower conduit and the casing being operable to cooperatively define a lower annulus therebetween when the well completion assembly is positioned in the wellbore.

20. A well completion assembly according to claim 19; and a lower packer coupled to the lower conduit, said lower packer being operable to fluidly isolate a top portion of the lower annulus from a bottom portion of the lower annulus.

21. A well completion assembly positionable within a cased subterranean wellbore, said well completion assembly comprising:

an elongated upright member extending along a member axis and presenting a generally cylindrical outer surface;

a perforating gun fixed relative to the member and axially positioned alongside the member, said perforating gun being operable to propel a plurality of perforating charges outwardly therefrom in a manner such that the perforating charges do not contact the member, said member being a filter including a porous wall that defines an interior filter space and presents the outer surface, said perforating gun being positioned outside the porous wall;

an upper conduit coupled to the filter, fluidly communicating with the interior filter space, and extending axially from the filter, said upper conduit and the casing of the wellbore being operable to cooperatively define an upper annulus therebetween when the well completion assembly is positioned in the wellbore;

an upper packer coupled to the upper conduit and axially spaced from the filter, said upper packer being operable to fluidly isolate at least a portion of the upper annulus from the space in the casing above the upper packer;

a packing valve fluidly coupled to the upper conduit and disposed between the filter and the packer, said packing valve being selectively shiftable between an open position that permits fluid flow between the interior of the upper conduit and said at least a portion of the upper annulus through the packing valve and a closed position that at least substantially blocks fluid flow between the interior of the upper conduit and said at least a portion of the upper annulus through the packing valve;

a lower conduit coupled to the filter, fluidly communicating with the interior filter space, and extending axially from the filter on a generally opposite side of the filter as the upper conduit, said lower conduit and the casing being operable to cooperatively define a lower annulus therebetween when the well completion assembly is positioned in the wellbore;

a lower packer coupled to the lower conduit, said lower packer being operable to fluidly isolate a top portion of the lower annulus from a bottom portion of the lower annulus;

a second filter fluidly coupled to the lower conduit and disposed proximate the bottom portion of the lower annulus; and a second perforating gun axially positioned alongside the second filter.

22. A well completion assembly according to claim 21; and a second packing valve coupled to the lower conduit and disposed between the second filter and the lower packer, said second packing valve being selectively shiftable between an open position that permits fluid flow between the interior of the lower conduit and the bottom portion of the lower annulus through the second packing valve and a closed position that at least substantially blocks fluid flow between the interior of the lower conduit and the bottom portion of the lower annulus through the second packing valve.

23. A completed well operable to produce fluids from a subterranean formation, said completed well comprising:

a generally upright string of casing;

a packer disposed in the casing and fluidly isolating an upper portion of the casing from a lower portion of the casing;

an elongated upright filter at least partly disposed in the lower portion of the casing and cooperating with the casing to define a filter annulus therebetween;

a perforating gun at least partly disposed in the filter annulus;

a plurality of perforations extending through the casing and into the subterranean formation adjacent the filter annulus; and a packing material disposed in the filter annulus, said packing material being operable to inhibit the flow of small solid particles of the subterranean formation from the perforations to the filter.

24. A completed well according to claim 23; and a string of production tubing disposed in the casing, fluidly communicating with the filter, and extending upwardly from the packer, said filter being a selective screen.

25. A completed well according to claim 24; and a packing valve fluidly communicating with the production tubing and disposed between the filter and the packer, said packing valve being shiftable between an open position where fluid communication is provided between the interior of the production tubing and the filter annulus through the packing valve and a closed position where fluid flow between the interior of the production tubing and the filter annulus through the packing valve is substantially blocked.

26. A completed well according to claim 25; and a second packer disposed in the casing below the filter and operable to fluidly isolate a top portion of the lower portion of the casing from a bottom portion of the lower portion of the casing; and a conduit fluidly communicating with the filter, extending downwardly from the filter, and coupled to the second packer.

27. A completed well according to claim 26; and a second filter disposed below the second packer and fluidly communicating with the conduit; and a second perforating gun vertically positioned alongside the second filter.

28. A completed well according to claim 27; and a second packing valve fluidly communicating with the conduit and disposed between the second filter and the second packer.

29. A method of completing a cased well extending in a subterranean formation that holds fluid deposits, said method comprising the steps of:

(a) securing a completion assembly comprising an elongated upright conduit and a perforating gun relative to the casing of the well in a fixed position;

(b) perforating the casing with the perforating gun while the completion assembly is in the fixed position;

(c) packing the well by conveying a packing material downwardly through the conduit while the completion assembly is in the fixed position; and (d) producing fluids from the fluid deposits via the conduit while the completion assembly is in the fixed position.

30. A method according to claim 29, said conduit comprising a string of production tubing; and (e) prior to step (a), placing a rig over the well;

(f) running the production tubing into the well using the rig; and (g) prior to step (b), removing the rig from the well, steps (b), (c), and (d) being performed while the rig is removed from the well.

31. A method according to claim 29; and (h) between steps (c) and (d), running coiled tubing at least partly into the conduit.

32. A method according to claim 31; and (i) between steps (h) and (d), cleaning out the conduit with the coiled tubing.

33. A method according to claim 29, said completion assembly comprising a packer, step (a) including setting the packer above the perforating gun.

34. A method according to claim 29, said completion assembly including a porous filter fluidly coupled to the conduit and vertically positioned alongside the perforating gun.

35. A method according to claim 34, said completion assembly including a packer, said conduit extending through the packer, said conduit cooperating with the casing to define an annulus therebetween, step (a) including setting the packer to thereby fluidly isolate an upper portion of the annulus from a lower portion of the annulus, said perforating gun being disposed proximate the lower portion of the annulus.

36. A method according to claim 35, said completion assembly including a packing valve fluidly coupled to the conduit and disposed between the packer and the filter, step (c) including opening the packing valve to thereby provide for fluid communication between the lower portion of the annulus and the conduit.

37. A method according to claim 36, step (c) including passing the packing material through the conduit, through the packing valve, and into the lower portion of the annulus.

38. A method according to claim 37, said packing valve being closed during step (d).

39. A method according to claim 29, said completion assembly including a selective screen fluidly communicating with the conduit, step (d) including opening the selective screen and conducting the produced fluids through the packing material, the selective screen, and upwardly through the conduit.

40. A method according to claim 29, step (c) including stimulating the well by simultaneously conveying a mixture of the packing material and a hydraulic fracturing fluid downwardly through the conduit.

41. A method of completing a cased well extending in a subterranean formation that holds fluid deposits in at least two vertically spaced production zones, said method comprising the steps of:

(a) securing a completion assembly comprising an elongated upright conduit, a first perforating gun, and a second perforating gun relative to the casing of the well in a fixed position;

(b) perforating the casing in a first vertical location with the first perforating gun while the completion assembly is in the fixed position;

(c) perforating the casing in a second vertical location with the second perforating gun while the completion assembly is in the fixed position;

(d) tacking the second vertical location with a packing material while the completion assembly is in the fixed position; and (e) packing the first vertical location with the packing material while the completion assembly is in the fixed position.

42. A method according to claim 44, said conduit and the casing defining an annulus therebetween, said completion assembly including first and second packers, step (a) including fluidly isolating an upper portion of the annulus from a middle portion of the annulus with the first packer, step (a) including fluidly isolating a lower portion of the annulus from the middle portion of the annulus with the second packer, said first perforating gun being disposed in the middle portion of the annulus, said second perforating gun being disposed in the lower portion of the annulus.

43. A method according to claim 42, said completion assembly including first and second packing valves fluidly coupled to the conduit, said first packing valve being operable to selectively provide fluid communication between the conduit and the middle portion of the annulus, said second packing valve being operable to selectively provide fluid communication between the conduit and the lower portion of the annulus.

44. A method according to claim 43, step (d) including conducting the packing material downwardly through the conduit, out through the second packing valve, and into the lower portion of the annulus.

45. A method according to claim 44, step (e) including conducting the packing material downwardly through the conduit, out through the first packing valve, and into the middle portion of the annulus.

46. A method according to claim 45, step (e) being performed after step (d).

47. A method according to claim 45, said completion assembly including a first porous filter fluidly communicating with the conduit and vertically positioned beside the first perforating gun and a second porous filter fluidly communicating with the conduit and vertically positioned beside the second perforating gun.

48. A method according to claim 47, said first and second filters being selective screens.

49. A method according to claim 45;

step (d) including stimulating the second vertical location by conducting a mixture of the packing material and a hydraulic fracturing material downwardly through the conduit, out through the second packing valve, and into the lower portion of the annulus, step (e) including stimulating the first vertical location by conducting a mixture of the packing material and the hydraulic fracturing fluid downwardly through the conduit, out through the first packing valve, and into the middle portion of the annulus.

* * * * *

UNITED STATES PATENT AND TRADEMARK OFFICE

CERTIFICATE OF CORRECTION

PATENT NO. : 6,675,893 B2
DATED : January 13, 2004
INVENTOR(S) : Hans-Jacob Lund It is certified that error appears in the above-identified patent and that said Letters Patent is hereby corrected as shown below:

Column 15,
Line 16, delete “tacking” and insert therefore -- packing --.
Line 22, delete “44” and insert therefore -- 41 --.

Signed and Sealed this

Eleventh Day of May, 2004

JON W. DUDAS
*Acting Director of the United States Patent and Trademark Office*